United States Patent [19]

Caron et al.

[11] Patent Number: 4,865,400

[45] **Date of Patent: * Sep. 12, 1989**

[54] DEMOLITION AND COMPACTION TRACK SHOE AND ASSEMBLY FOR CRAWLER VEHICLE

[75] Inventors: James O. Caron; Kenneth H. Pratt, both of Modesto, Calif.

[73] Assignee: Caron Compactor Co., Modesto, Calif.

[ * ] Notice: The portion of the term of this patent subsequent to Jun. 14, 2006 has been disclaimed.

[21] Appl. No.: 195,581

[22] Filed: May 13, 1988

Related U.S. Application Data

[63] Continuation of Ser. No. 887,156, Jul. 17, 1986, Pat. No. 4,750,792, which is a continuation-in-part of Ser. No. 653,661, Sep. 21, 1984, abandoned.

[51] Int. Cl.[4] ..... B62D 55/24

[52] U.S. Cl. ..... 305/54; 305/39

[58] Field of Search ..... 305/53, 54, 39; 301/43, 301/44

[56] References Cited

U.S. PATENT DOCUMENTS

| | | | |
|---|---|---|---|
| 2,470,801 | 5/1949 | Boltman | 305/54 X |
| 2,712,964 | 7/1955 | Waller | 305/53 |
| 2,823,082 | 2/1958 | Bauer Jr. | 305/53 |
| 2,866,667 | 12/1958 | Ratkowski | 305/54 |
| 3,355,225 | 11/1967 | McDowell et al. | 305/53 |
| 4,043,610 | 8/1977 | Halmosi et al. | 305/35 EB |
| 4,278,302 | 7/1981 | Westimayer et al. | 305/54 |
| 4,750,792 | 6/1988 | Caron et al. | 305/54 |

*Primary Examiner*—Russell D. Stormer

*Attorney, Agent, or Firm*—Flehr, Hohbach, Test, Albritton & Test

[57] ABSTRACT

A demolition and compaction track shoe and assembly for a crawler vehicle track includes a central opening and diagonally oriented demolition blades protruding sufficiently outwardly to be primarily useful in demolishing large rocks, home appliances, and similar materials of a type generally encountered in a land fill site. The diagonally oriented demolition blades cooperate with transversely disposed grouser blades to obtain a smoother riding, stable, self-cleaning track. The grouser blades extend only part way across the track shoe in a manner leaving a lateral spacing or gap between the adjacent ends of the grousers so as to provide a scissoring action on debris captured between adjacent grousers of adjacent track shoes in the track.

8 Claims, 5 Drawing Sheets

FIG_7
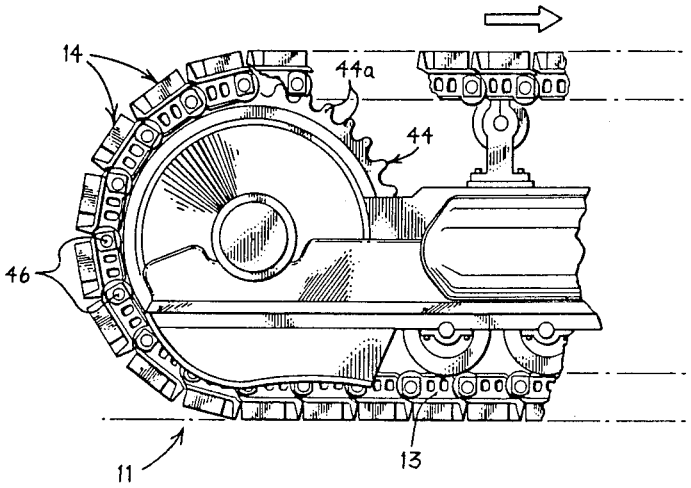
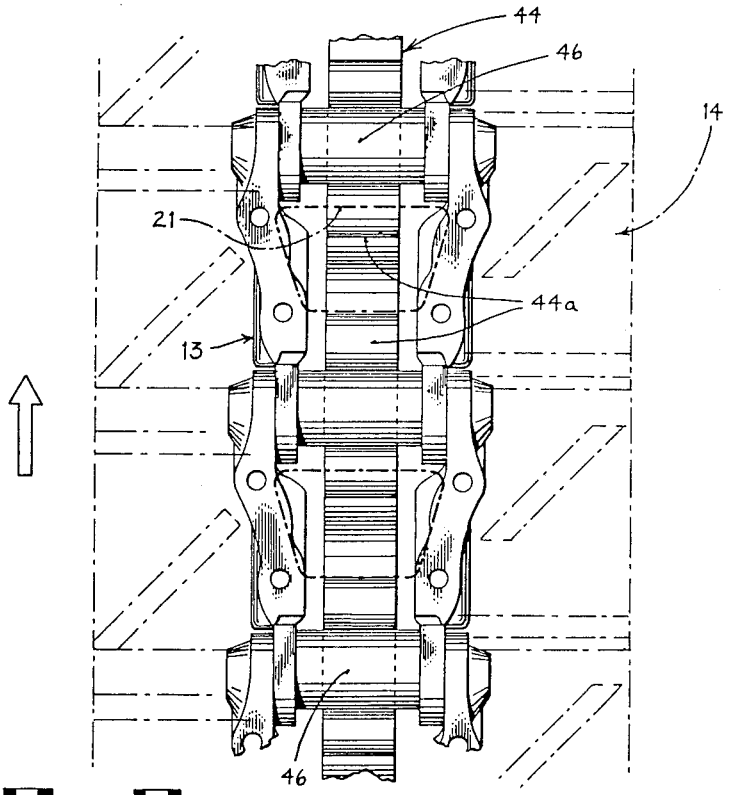
FIG_8

DEMOLITION AND COMPACTION TRACK SHOE AND ASSEMBLY FOR CRAWLER VEHICLE

This application is a continuation of Ser. No. 887,156 filed July 17, 1986 and now U.S. Pat. No. 4,750,792, which is a continuation-in-part of Ser. No. 653,66I filed Sept. 21, 1984 and now abandoned.

BACKGROUND OF THE INVENTION

This invention pertains to crawler type vehicles and more particularly to an improved cyclic track assembly and track shoe for same suitable for demolition and compaction of fill materials such as earth, debris, solid wastes, trash, etc.

Previously, wheeled vehicles having special compacting feet have been used in compacting sanitary land fills, dumps, construction sites, etc. Also, track type tractors using tracks designed solely for tractive purposes have been used for this purpose. Such vehicles have had certain limitations. For example, they have had difficulty in effectively demolishing large rocks, pieces of concrete, etc., as encountered at construction sites. Also, when compacting "wet" materials using the usual track type tractor, it has been observed that the materials become impacted behind the track shoes so as to tighten the tracks unduly.

Further, in compacting fill materials such as trash and earth at a sanitary land fill site, it has been found to be more efficient if the trash is demolished prior to or during compaction of the fill materials so that smaller debris can be compressed into the earth.

In addition, where corn stubble has been left in a field after harvesting, wheel-style compactors have a limited ability to break up the stubble prior to discing the stubble into the ground. Since burning of stubble has been prohibited in many areas, it must now be disced into the ground.

A crawler vehicle equipped with track shoes or pads as disclosed herein readily serves to break up the stubble even more thoroughly than when using only the disc.

Thus, there has been a need for an improved compactor for use on sanitary land fills, transfer stations for garbage, and for construction and demolition sites.

SUMMARY OF THE INVENTION AND OBJECTS

In general, there has been provided a demolition and compaction track shoe and assembly for a track-type tractor vehicle in which the tracks are characterized by a rigid shoe structure having a central opening therethrough and a pair of grouser blades and demolition blades. The grouser blades lie substantially normal to the underside of the shoe as well as to the path of the track. The demolition blades lie substantially normal to the underside of the shoe but at a substantial angle to the path. The demolition and grouser blades are disposed and arranged about the central opening in a manner forming escape channels permitting fill material emerging from behind the shoe via the central opening to be freely released from the tread surface as well as from the back side of the shoe to cause the track to run clean. Thus, both grouser blades extend only part way across the width of the shoe and are mutually offset to opposite sides of the center line of the track path while the demolition blades are disposed in spaced relation to the grouser blades. In this way, fill materials are discharged from the region behind the shoe as well as from the tread surface. The above action helps to prevent harmful buildup of fill materials on the back side of the shoe.

In general, it is an object of the invention to provide an improved compactor vehicle wherein the tread reduces the fill materials (such as concrete blocks, rocks, solid waste, etc.) before it grinds them into the ground.

Another object of the invention is to provide a compactor vehicle having crawler tracks which "run clean," i.e., remain substantially free of any significant impacted buildup of fill material behind or in the tread.

A further object of the invention is to provide an improved method of compaction of fill materials.

Yet another object of the invention is to provide an improved crawler track which enhances stability and smoothness of operation of a compaction vehicle.

The foregoing and other objects of the invention will become more readily evident from the following detailed description of a preferred embodiment when considered in conjunction with the drawings.

BRIEF DESCRIPTION OF THE DRAWINGS

FIG. 7 shows a diagrammatic side elevation view of a track assembly for the vehicle in FIG. 2;

FIG. 8 shows a diagrammatic plan view of two links coupled in tandem taken from the track assembly of FIG. 7;

DESCRIPTION OF PREFERRED EMBODIMENTS

Figure 1:
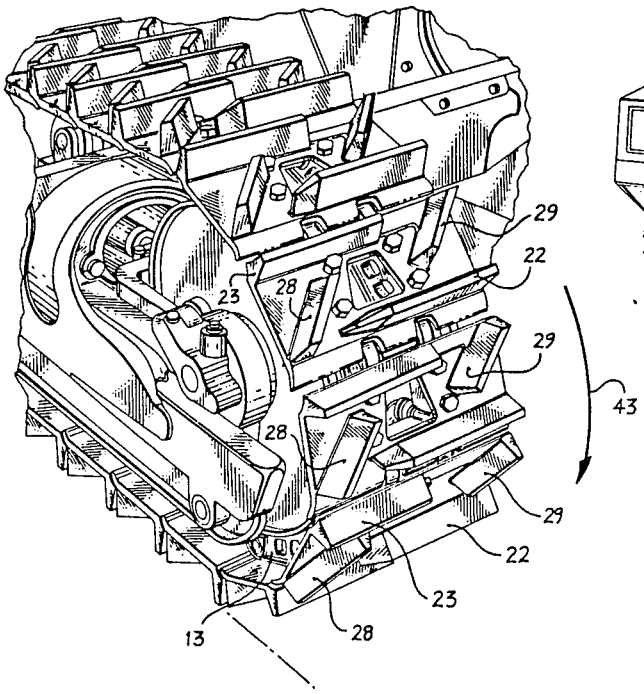
FIG. 1 shows a diagrammatic perspective view of the leading end of a crawler track, according to the invention.
Figure 2:
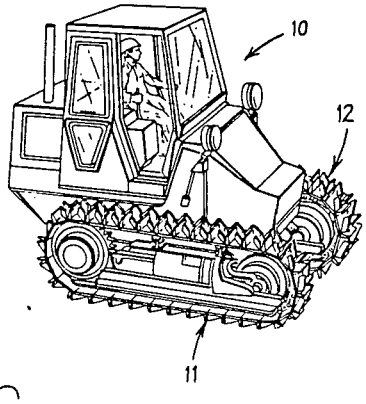
FIG. 2 shows a diagrammatic perspective view of a track type vehicle supported by track assemblies according to the invention.

A crawler vehicle 10 for use in compacting a fill of materials, such as earth and debris, employs a pair of spaced parallel endless track assemblies 11, 12, shown in greater detail in FIGS. 1 and 7. Track assemblies 11, 12 include a plurality of articulated links 13 coupled in tandem to form an endless or cyclic "belt". Links 13 support track shoes 14 secured thereto by means of bolts 16.

Vehicle 10 uses its tracks to demolish and compact a fill of materials such as earth and debris, rocks, refuse, etc.

Figure 4:
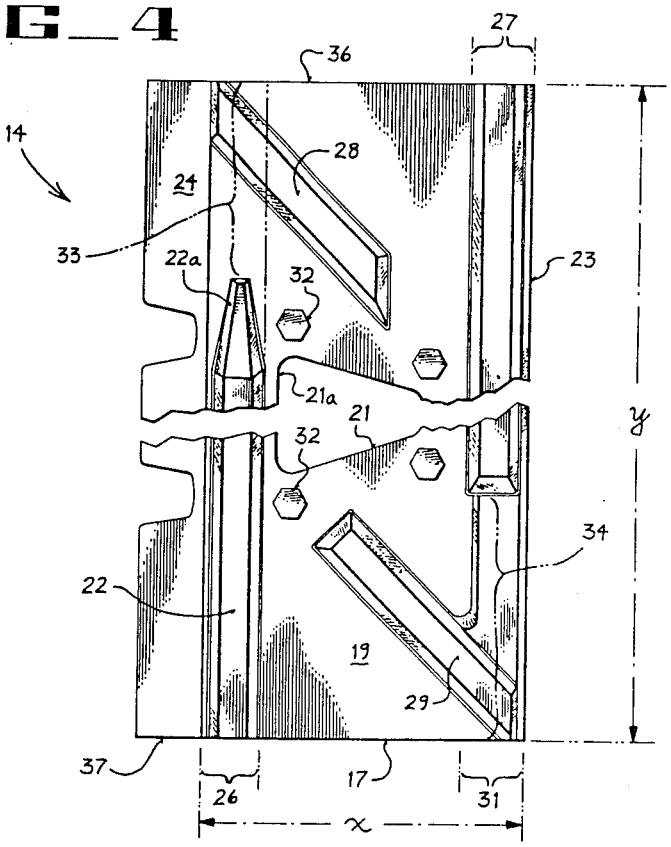
FIGS. 4 and 5 respectively show bottom plan and end elevation views of a track shoe according to the invention and inverted as when out of contact with the ground.
Figure 5:
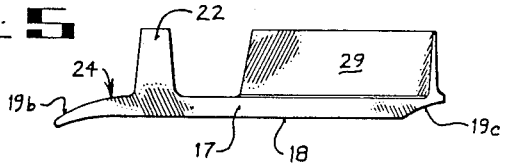

Each shoe 14 comprises substantially a rigid rectangular plate 17. Plate 17, for purposes of explanation, includes a top and a bottom surface 18, 19 respectively (FIGS. 4, 5). As used herein the term "bottom" surface pertains to that surface which acts as a tread surface for engaging the ground as vehicle 10 is moved. It will be readily evident, however, that the "bottom" surface 19, when inverted (as in FIGS. 4 and 5) becomes a "top" surface during a substantial portion of its cyclic travel but shall continue to be referred to herein as he "bottom" surface.

A relief opening 21 in the form of a relatively large trapezoidal shaped opening extends centrally through shoe 14. Opening 21 is sufficiently large to readily release fill material outwardly therethrough so as to inhibit the buildup of compacted materials behind shoe 14.

As shown, for example, in FIG. 5 the leading or left-hand edge **19*b* curves slightly downwardly so as to slide under the trailing edge 19*c* of a shoe 14 preceding it in track assembly 11. The leading edge margin 24 of plate 17 serves to provide a closure between shoes disposed in tandem along track assembly 11. Accordingly, as the shoes 14 travel a horizontal stretch of their path, edge margin 24 will be disposed beneath trailing edge 19*c* of a preceding shoe 14**.

The remainder of the bottom surface of shoe 14 provides a substantial region for engaging the ground referred to herein as the "tread" surface. Thus, as shown in FIG. 4 the region defined within the dimensions x, y comprises the tread surface.

A drive sprocket 44 engages link pins 46 to move the track assembly. The sprocket points are aligned to pass directly beneath opening 21 whereby they can assist in urging impacted material out of opening 21.

As shoes 14 travel around the ends of their cyclic path, edges **19*b* and 19*c* of adjacent shoes move to open and close a gap therebetween. This action as well as that of the drive sprocket 44 causes impacted materials to be urged outwardly through opening 21, as well as to create a scissoring action between adjacent grouser blades as described below in another embodiment. (See FIGS. 9–15**.)

A pair of grouser blades 22, 23 carried from the bottom surface of shoe 14 protrude generally normal to the tread surface and respectively extend transversely of shoe 14 along a substantial part of the extent of the leading and trailing transverse edge margins, 26, 27 of tread surface x, y (FIG. 4). Grouser blades 22, 23 are mutually offset laterally to opposite sides of the center line of the path of movement of track shoes 14 for reasons described further below.

In addition, bottom surface 19 carries a pair of demolition blades 28, 29 which also protrude generally normal to the region of tread surface x, y. Demolition blades 28, 29 have a length of the order of substantially one-half the length of grouser blades 22, 23 and protrude at least substantially to the same degree as the grousers. In this way blades 28, 29 have sufficient rigidity and exposure to be able to demolish large articles as many be found at land fill sites. Thus, blades 28, 29 must protrude sufficiently from tread surface 19 to be useful in destroying large rocks and articles of a type encountered at a land fill site. Blades 28, 29 extend diagonally substantially in parallel relation respectively from the leading and trailing edge margins 26, 31 toward the trailing and leading edge margins 31, 26 respectively for purposes of demolishing debris while permitting any impacted material emerging from opening 21 to freely leave the track.

Grouser 22 includes a tapered fillet **22*a* which serves to strengthen plate 17 in the region of the leading edge 21*a* of opening 21 and the openings (not shown) for bolts 32. Thus, the bolt holes and the elongate edge 21*a* cause the adjacent portion of plate 17 to be the weakest portion. This weakening of a leading portion of plate 17 has thereby been stiffened by the inclusion of the tapered fillet 22*a***.

Both of blades 22, 23 extend only part way across the full width, y, of shoe 14 and are mutually offset to opposite sides of the centerline of the path of its associated track. Each displacement 33, 34 (FIG. 4) respectively defined between the laterally inner ends of an associated grouser blade 22, 23 and a side edge 36, 37 of the rigid plate includes a gap 38, 39 respectively defined between the laterally inner end of an associated grouser blade and a portion of a demolition blade invading the plane of the grouser blade. Gaps 38, 39 serve to channel debris 42 away from shoe 14. Additional gaps or channels for debris to fall through are indicated at 38' and 39'. Demolition blades 28, 29 lie mainly behind an associated one of gaps 38, 99 in the path of fill materials 42 passing therethrough.

Figure 6:
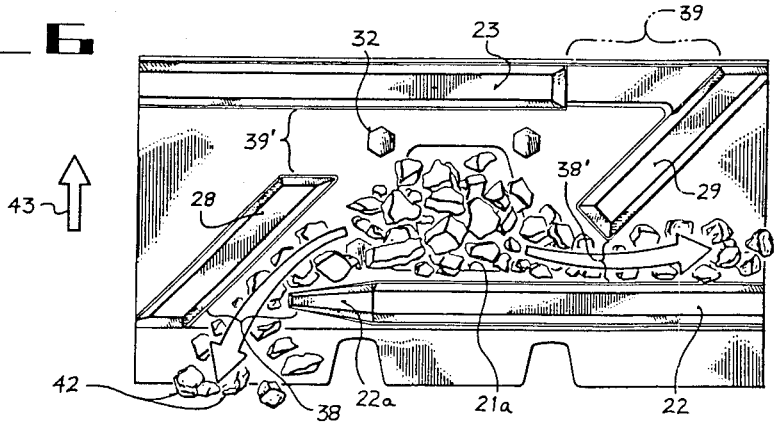
FIG. 6 shows a diagrammatic representation of the passage of debris from behind the track shoe and away from the tread surface.
Figure 9:
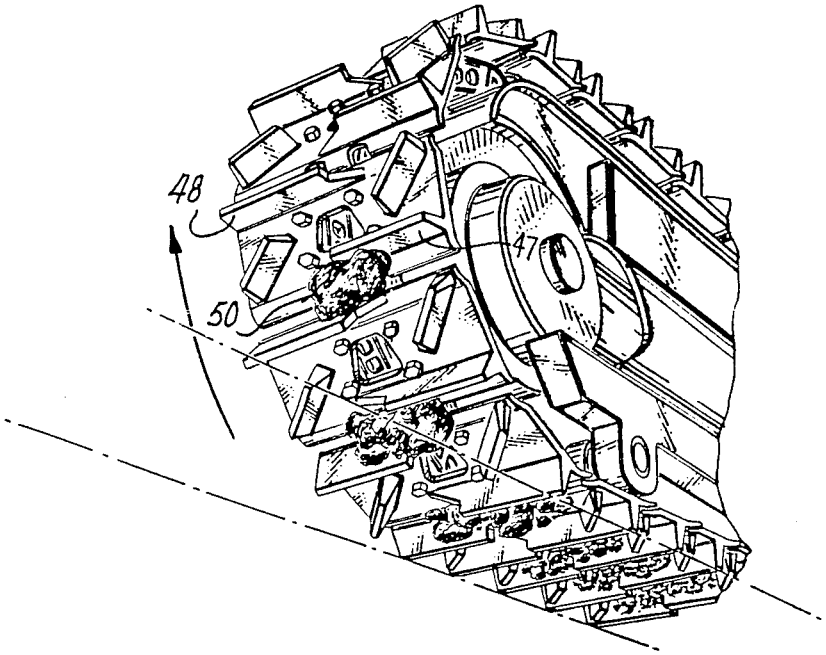
FIG. 9 shows a diagrammatic perspective view as viewed from behind and beneath a track assembly according to another embodiment of the invention.

Assuming that FIG. 6 represents a track shoe 14 moving upwardly in the direction of arrow 43 as the vehicle moves in a forward direction, i.e., as the track assembly is viewed from behind, impacted debris 42 in back of shoe 14 will be shaken loose by the relative movement between shoes 14 as they move around the end of their cyclic path as well as by the action of the drive sprocket 44.

As shoe 14 travels upwardly channels 38, 38' permit the loosened debris 42 to pass freely from shoe 14 by gravity. Channels 39, 39' perform this function when the track moves in a reverse direction.

Thus, as noted above, the tracks are designed to run "clean" so as to rid themselves of refuse and other fill materials rather quickly. For a demolition and compaction vehicle, use of the crawler style tracks further enhances this feature inasmuch as the shoes are drawn apart as they pass around the ends of the track. In this manner the tracks further tend to release material. This "track break" between consecutive shoes opens up a slot between shoes giving entrapped debris an opportunity to fall out. Further, by reducing the material in size before grinding it into the ground, the vehicle described above achieves compaction by a substantially different technique than previously.

It has been observed that track shoes 14 of the kind described serve to provide an improved and enhanced stability and smoother ride. Accordingly, shoe 14 includes means protruding therefrom to continuously form a support beneath plate 17 in the region extending between grouser blades 22, 23. Thus, as each tread surface progressively engages the ground, it will be continuously supported from grouser 22 to grouser 23.

Figure 3:
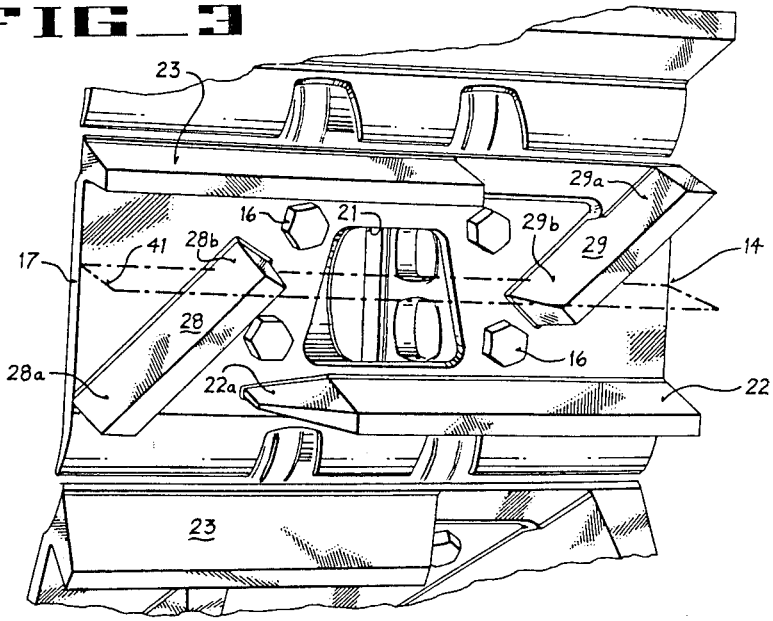
FIG. 3 shows an enlarged detail perspective view of a track shoe according to the invention.

As shown best in FIGS. 1 and 3, and as indicated by arrow 43, as the track moves forward (for purposes of explanation) the leading grouser blade 22 will be the first to strike the ground. At substantially the same time, the leading end **28*a* of demolition blade 28 will make contact with the ground followed by demolition blade 29. Ultimately, grouser blade 23** engages the ground and the entire shoe will then be in a substantially horizontal downwardly facing position while moving along the bottom reach of its track.

This progressive contact and continuous support beneath each shoe serves to eliminate much of the instability previously observed and causes the vehicle to ride more smoothly.

More particularly, one end 28*a*, 29*a* of each of demolition blades 28, 29 invades the plane defined by an associated one of the two grouser blades 22, 23 respectively. The other end 28*b*, 29*b* of each of blades 28, 29 extends substantially beyond an imaginary plane 41 common to each of the ends 28*b*, 29*b*, and disposed substantially normal to the path of an associated one of the tracks 11, 12. Plane 41 lies between the pair of grouser blades 22, 23.

It has been observed that the use of a compaction vehicle 10 of the kind described characterized by the demolition blades and shoe design provides enhanced reduction of concrete blocks, rocks, wood products and the like encountered at building sites so that the debris material is reduced in size merely by driving the vehicle back and forth across the debris.

It has further been observed that a vehicle equipped with tracks of the kind described achieves the desired results more quickly than previously whereby the machine actually is called upon to work fewer hours with attendant fuel and labor savings.

The smoother ride created by the diagonal segments prevents the machine from rocking and falling from one grouser to the next and enhances the comfort of the operator as well as reducing metal fatigue and machine damage.

Finally, it has been noted that in many farming communities it is unlawful to burn corn stubble so that farmers in such areas are required to disc the corn stubble back into the ground. The crawler vehicle described above can break up such corn stubble prior to discing so as to achieve a more thorough discing. Further, this can be done all at once if the vehicle tows a disc through the field.

It has further been observed that since the shoes 14 are carried by conventional track links 13, shoes 14 can be employed together with conventional shoes of the type used on track-type tractors. For example, shoe 14 can be alternated with a standard shoe as desired at the expense of a commensurate loss in function and efficiency.

According to one method of operation, after first reducing debris materials in size, tracks 11, 12 can be driven in opposite directions onto the debris and in this manner virtually "screw" the material into the ground.

According to another embodiment of the invention as and trailing grouser blades 47, 48 formed in a manner originating from opposite side edges of shoe 45 and ending short of a laterally overlapping relation. Thus, the laterally inner ends of the edges of grousers 47, 48 slightly "underlap" each other.

Figure 10:
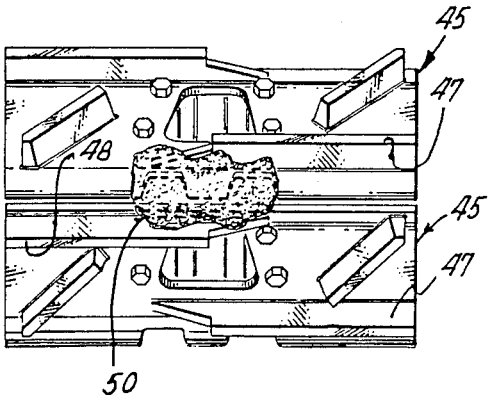
FIGS. 10 and 11 diagrammatically show in end elevation successive stage of demolition accomplished by the embodiment shown in FIG. 9.
Figure 11:
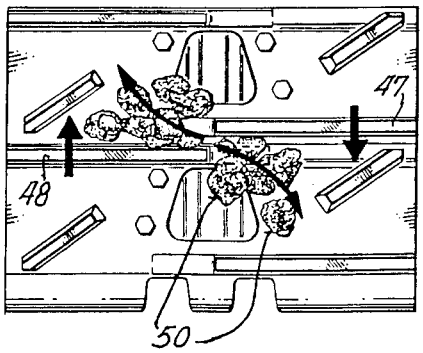
Figure 12:
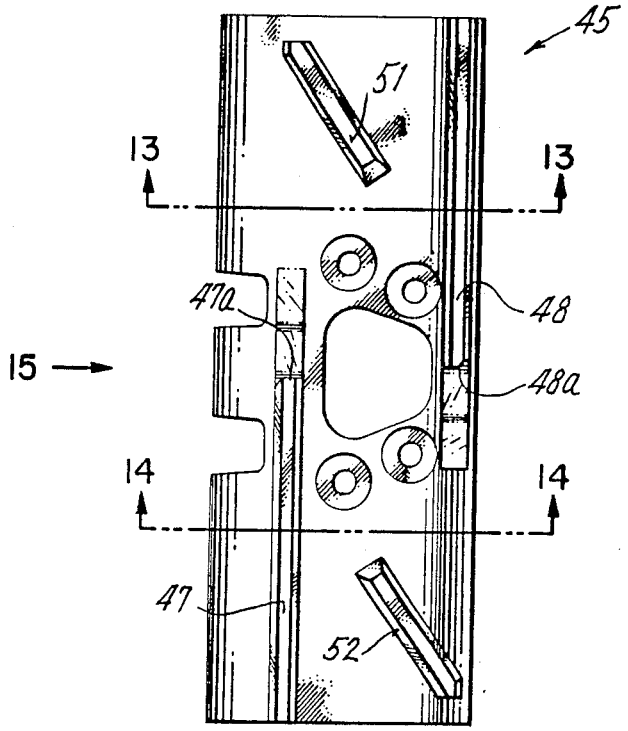
FIG. 12 shows a plan view of a track shoe according to the embodiment shown in FIG. 9.
Figure 13:
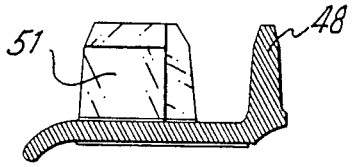
FIGS. 13, 14 and 15 show end elevation section views taken along lines 13—13 and 14—14 of FIG. 12 and as viewed in elevation from the direction of arrow 15.
Figure 14:
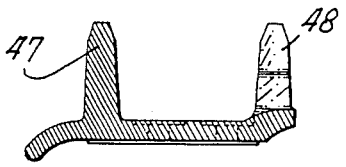

As noted above adjacent track shoes of a crawler track move relative to each other as they travel in a cyclic path. This action causes the leading and trailing grousers 47, 48 of tandemly adjacent track shoes respectively to compress and crush any debris 50 captured therebetween (FIG. 10).

Figure 15:
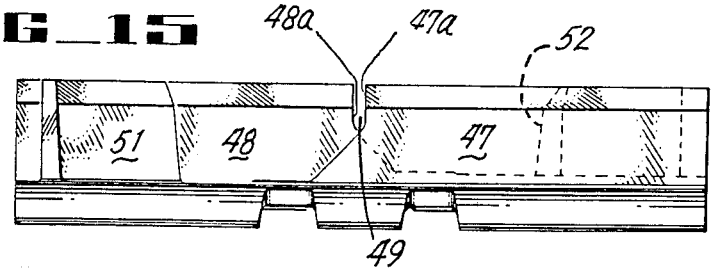

The edge portions of the laterally inner ends of grousers 47, 48 are close but "underlapped" to provide a scissors-like action between the inner ends so as to shear the captured debris. It has been observed that, as best shown in FIG. 15, this shearing action is effective even though the spacing defined between the laterally inner ends 47*a*, 48*a* defines gap 49 to extend less than the full height of grouser blades 47, 48.

As thus arranged, both grouser blades 47, 48 extend only part way across the width of shoe 45. Blades 47, 48 are offset to opposite sides of the centerline of the path of the track carried by the crawler vehicle and disposed in a manner whereby edge portions of the laterally inner ends 47*a*, 48*a* of the grouser blades serve to define a narrow gap 49 therebetween. As track shoes 45 move between advanced and retracted positions with respect to each other during their cyclic travel, grouser blade 48 on the trailing edge of shoe 45 moves relatively toward grouser blade 47 on the leading edge of the track shoe 45 immediately following the leading track shoe. The laterally inner ends of grouser blades 47, 48 on tandemly adjacent shoes 45 of the crawler track serve to shear debris 50 captured therebetween as the track shoes move relative to each other.

Accordingly, advantage has been taken of the fact that the shoes on a crawler track move relative to one another to provide a "scissors-like" action to destroy any entrapped debris caught in the track.

Finally, demolition blades 51, 52 carried by the shoe 45 provide the smooth, stable qualities noted above while serving to destroy some of the larger debris.

We claim:

1. In a crawler vehicle for use in compacting a fill of earth and debris, the vehicle being of a type supported by spaced parallel endless tracks in which the tracks include a plurality of articulated links readily releasably coupled to and supporting track shoes therefrom, said shoes each comprising a broad, rigid plate having top and bottom surfaces, a substantial region of the bottom surface acting as a tread surface for engaging the ground, a relief opening formed to extend centrally through said tread surface, said opening being sufficiently large to readily pass fill materials outwardly therethrough to inhibit buildup of impacted materials on the back side of said track shoes, a pair of grouser blades and a pair of demolition blades carried to protrude generally normal to said tread surface of said track shoes, said demolition and grouser blades being disposed to define escape channels for readily permitting material discharged from said opening to freely leave the track shoe, said pair of grouser blades respectively extending along a substantial portion of the leading and trailing edge margins of said tread surface, said grouser blades being mutually offset laterally to opposite sides of the centerline of the path of movement of the track shoes, and said pair of demolition blades extending diagonally substantially in parallel relation respectively from the leading and trailing edge margins of said tread surface toward said trailing and leading edge margins for demolishing debris, said demolition blades being spaced from said grouser blades to define said channels for freely passing from said track the material discharged from said opening.

2. A track shoe for a vehicular crawler track of a type for crushing, breaking, grinding and compacting a fill of earth and debris materials, said shoe comprising a broad, rigid plate having top and bottom surfaces, a substantial region of the bottom surface acting as a tread surface for engaging the ground, a relief opening formed to extend centrally through said tread surface, said opening being sufficiently large to readily release fill materials outwardly therethrough to inhibit buildup of impacted material behind said track shoe, a pair of grouser blades protruding generally normal to said tread surface and respectively extending along a substantial portion of the leading and trailing edge margins of said tread surface, said grouser blades being mutually offset laterally to opposite sides of the centerline of the path of movement of the track shoes, first and second substantially parallel demolition blades protruding generally normal to said tread surface and extending diagonally respectively from the leading and trailing edge margins of said tread surface toward said trailing and leading edge margins, said demolition blades protruding sufficiently to be primarily useful in destroying large rocks, home appliances and similar trash material of a type typically found at landfill sites, said demolition blades being spaced from said grouser blades to define gaps therebetween serving to channel the material released from said opening free of said shoe.

3. In a crawler vehicle for use in compacting fill materials of earth, debris, solid or liquid waste, the vehicle being of a type supported by spaced parallel endless tracks in which the tracks include a plurality of articulated links, said links supporting track shoes, said shoes comprising means for readily releasably coupling said shoes to an associated one of said links to permit a worn or damaged track shoe to be removed from its track while said track remains assembled, said shoes including, a broad, rigid plate having top and bottom surfaces, a substantial region of the bottom surface acting as a tread surface for engaging the ground, a relief opening formed centrally of said tread surface and extending through said shoe for passing material therethrough from behind said shoe to inhibit buildup of impacted fill materials behind said shoe, the region of said tread surface having leading and trailing edge margins extending transversely of the path of the track associated with the shoe, grouser blade means protruding generally normal to said tread surface and extending from an end of one of said edge margins along a substantial portion thereof and terminating sufficiently short of the other end of said one edge margin to define a gap therebetween for fill materials to pass therethrough, said grouser blade means being offset laterally with respect to the center line of the path of movement of the track shoes to define gaps for passing fill materials therethrough from said relief opening, demolition blade means protruding generally normal to said tread surface and extending diagonally from said edge margin occupied by said grouser blade means toward the other said edge margin, said demolition blade means being disposed behind said gap to direct said fill materials toward said gap from said relief opening to be freely discharged from behind said shoe.

4. In a crawler vehicle for use in compacting fill materials of earth, debris or waste, the vehicle being of a type supported by spaced parallel endless tracks in which the tracks include a plurality of articulated links, said links supporting tracks shoes, said track shoes carrying means for readily releasably coupling said shoes to said ,links, said track shoes comprising a rigid plate having top and bottom surfaces, a substantial region of the bottom surface acting as a tread surface for engaging the ground, a central opening formed to extend through said plate, a pair of grouser blades and a pair of demolition blades protruding sufficiently to be primarily useful in destroying large rocks, home appliances and similar trash material of a type typically found at landfill sites, said grouser blades lying substantially normal to the underside of the shoe and the path of the tracks while the demolition blades lie substantially normal to the underside of said shoe but at a substantial angle to the path, both of said grouser blades extending only part way across the width of said shoe and substantially offset to opposite sides of the center line of the path of the track, the displacement between the laterally inner end of each said grouser blade and an associated side edge of said rigid plate forming a gap defined between said end of said grouser blade and a portion of one of said demolition blades, each said demolition blade being disposed to lie mainly behind its associated said gap and in the path of fill materials emerging from said central opening to cause said demolition blades to direct fill materials via said gap.

5. In a crawler vehicle of a type supported by spaced, parallel endless tracks for use in compacting fill materials of earth, debris, trash and the like, said endless tracks comprising a plurality of articulated links, track shoes carried by said links, means carried by each shoe for readily releasably coupling said shoes to an associated link, some of said shoes having top and bottom surfaces wherein a substantial region of the bottom surface serves as a tread surface for engaging the ground, a pair of grouser blades carried by said tread surface extending substantially normal to the path of its associated track, said grouser blades being spaced apart along said path, demolition means carried by and protruding from said tread surface, said demolition means being disposed to substantially continuously support said shoes in the region extending between said grouser blades as the shoe progressively engages the ground to enhance stability of said track, the last named means including a pair of demolition blades carried to protrude from said tread surface and extend diagonally of said path in substantially parallel relation, said demolition blades protruding sufficiently to be primarily useful in destroying large rocks, home appliances and similar trash material of a type typically found at landfill sites, an end of each of said demolition blades invading the plane of an associated grouser blade, the other end of each of said demolition blades extending substantially through an imaginary plane common to each of said other ends, said imaginary plane being disposed substantially normal to said path and intermediate said pair of grouser blades.

6. A track shoe for a vehicular crawler track of a type for crushing, breaking, grinding and compacting a fill of earth and debris materials, said shoe including a broad, rigid plate having top and bottom surfaces, a substantial region of the bottom surface acting as a tread surface for engaging the ground, a relief opening formed centrally of said tread surface and extending through said shoe for passing material therethrough from behind said shoe to inhibit buildup of impacted fill materials behind said shoe, said tread surface having leading and trailing edge margins extending transversely of the path of the track associated with the shoe, grouser blade means protruding generally normal to said tread surface and extending along an associated one of said edge margins, demolition blade means protruding generally normal to said tread surface and extending diagonally in the region between said edge margins and flanking said relief opening, said grouser blade means and said demolition blade means protruding sufficiently to be largely useful in destroying large rocks, home appliances and similar trash material of a type typically found at landfill sites, said grouser blade means being spaced with respect to said demolition blade means to define gaps for passing fill materials therethrough from said relief opening, said demolition blade means being disposed to direct said fill materials toward said gap from said relief opening to be freely discharged from behind said shoe.

7. In a crawler vehicle for use in compacting fill materials of earth, debris or waste, the vehicle being of a type supported by space parallel endless tracks in which the tracks include a plurality of articulated links, said links supporting track shoes, said track shoes carrying means for readily releasably coupling said shoes to said links, said track shoes each comprising a rigid plate having top and bottom surfaces, a substantial region of the bottom surface acting as a tread surface for engaging the ground, a central opening formed to extend through said plate, grouser blade means and demolition blade means protruding sufficiently from said tread surface to be respectively largely and primarily useful in destroying large rocks, home appliances and similar trash material of a type typically found at landfill sites, said grouser blade means lying substantially normal to the underside of the shoe and the path of the tracks while the demolition blade means lie substantially normal to the underside of said shoe but at a substantial angle to the path, said grouser blade means extending part way across the full width of said shoe and substantially offset to opposite sides of the demolition blade means to define a gap therebetween, said demolition blade means being disposed to lie mainly behind its associated said gap and in the path of fill materials emerging from said central opening to cause said demolition blade means to direct fill material via said gap.

8. In a crawler vehicle of a type supported by spaced, parallel endless tracks for use in compacting fill materials of earth debris, trash and the like, said endless tracks comprising a plurality of articulated links coupled in tandem to form an endless belt, track shoes carried by said links, bolt means carried by each shoe for readily releasably coupling each of said shoes to an associated link, some of said shoes having top and bottom surfaces wherein a substantial region of the bottom surfaces serves as a tread surface for engaging the ground, grouser blade means carried by and extending substantially normal to said tread surface, said grouser blade means being spaced apart along said path, said grouser blades protruding sufficiently from said tread surface to be secondarily useful for destroying large rocks, home appliances and similar trash material of a type typically found at landfill sites, demolition means carried by and protruding from said tread surface, said demolition means being disposed to substantially continuously support said shoes in the region extending between said grouser blades as the shoe progressively engages the ground to enhance stability of said track, the last named means including a pair of demolition blades carried to protrude from said tread surface and extend diagonally of said path and flanking a central opening formed to extend through the top and bottom surfaces of said shoe, said demolition blades protruding sufficiently from said tread surface to primarily useful in destroying large rocks, home appliances and similar trash material of a type typically found at landfill sites.

* * * * *